United States Patent [19]

Pendergraft

[11] Patent Number: 4,469,361

[45] Date of Patent: Sep. 4, 1984

[54] DERRICK SKY HOOK

[76] Inventor: Hugh W. Pendergraft, P.O. Box 342, Seymour, Mo. 65746

[21] Appl. No.: 487,109

[22] Filed: Apr. 21, 1983

[51] Int. Cl.[3] ..... A47F 13/06

[52] U.S. Cl. ..... 294/19 R

[58] Field of Search ..... 294/19 R, 19 A, 83, 294/104; 114/230, 221 R; 119/151, 153, 154, 96

[56] References Cited

U.S. PATENT DOCUMENTS 3,765,119 10/1973 Hare et al. ..... 294/19 R 3,918,385 11/1975 Wallace ..... 294/19 R

*Primary Examiner*—James B. Marbert

[57] ABSTRACT

This device is a derrick sky hook, including a long handle, a swivel at its one end carrying a U-shaped hook support, around which a knotted rope extends; the rope being tethered to an outer end of the hook support.

1 Claim, 4 Drawing Figures

DERRICK SKY HOOK

This invention relates generally to oil-drilling derricks. More specifically, it relates to hand tools that are associated with work performed upon oil-drilling rigs.

It is well known, to those persons who are acquainted with the particular field of oil-drilling rigs, that a stand of pipe sometimes is lost, and out of reach of the derrick man working high up on the derrick, so that he cannot grasp it even when, in his safety belt, he leans out over the edge of the floor. Thus, it is common for a derrick man, under the pressure of tripping in and out of the hole, to throw off his safety belt, and go after the lost stand of pipe. This dangerous action is known, sometimes, to prove fatal. The only other way of getting the pipe back is for the crew on the floor to wrap a cable around the pipe, and pull the cable tight, thus bringing the pipe back to the derrick man. This is time-consuming, and is also still quite dangerous to the derrick man, who can get hurt because there is no way to tell how hard or how fast the pipe will fall back toward the derrick man. This objectionable situation is, accordingly, in need of an improvement.

Therefore, it is a principal object of the present invention to provide a derrick sky hook, that permits the derrick man to stay in his safety belt, and yet be able to reach the lost stand of pipe.

Another object, accordingly, is to provide a derrick sky hook, which permits greater safety upon the drill rig, so that operation insurance will cost less and personnel feel more secure.

Other objects are to provide a derrick sky hook, which is simple in design, inexpensive to manufacture, rugged in construction, easy to use, and efficient in operation.

These, and other objects, will be readily evident, upon a study of the following specification, and the accompanying drawing, wherein.

Figure 1:
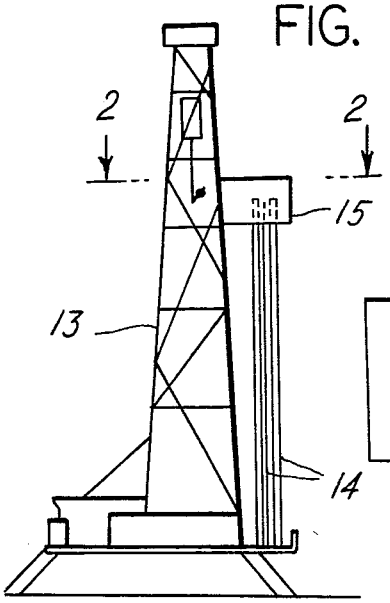
FIG. 1 is a side elevation view of a drilling rig, such as upon which the present invention is used by a derrick man standing on the derrick floor.
Figure 2:
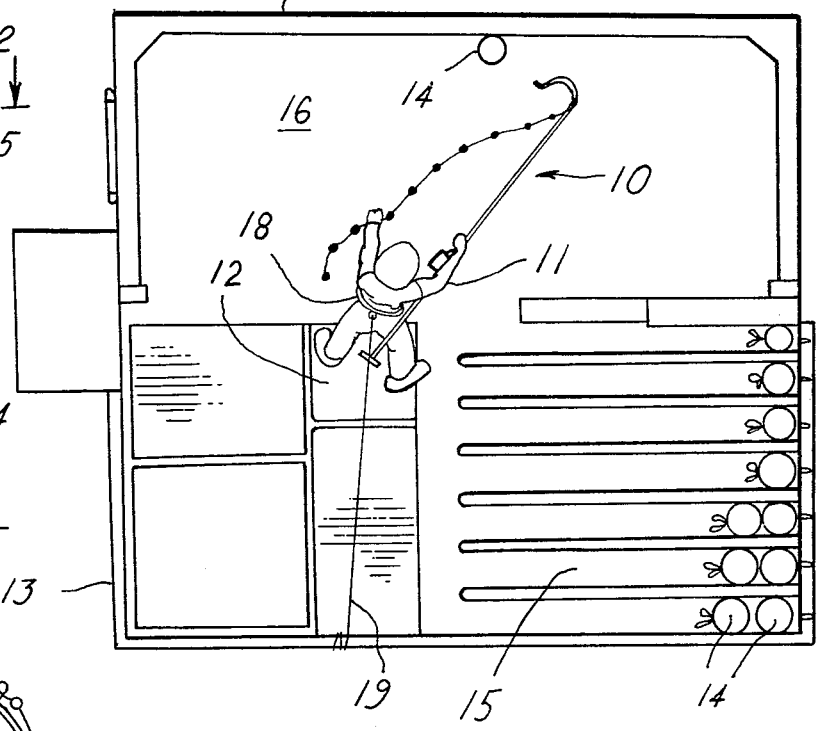
FIG. 2 is an enlarged top plan view, taken on line 2—2 of FIG. 1, and showing the derrick man using the present sky hook for retrieving a lost stand of pipe on a far side of the derrick.
Figure 3:
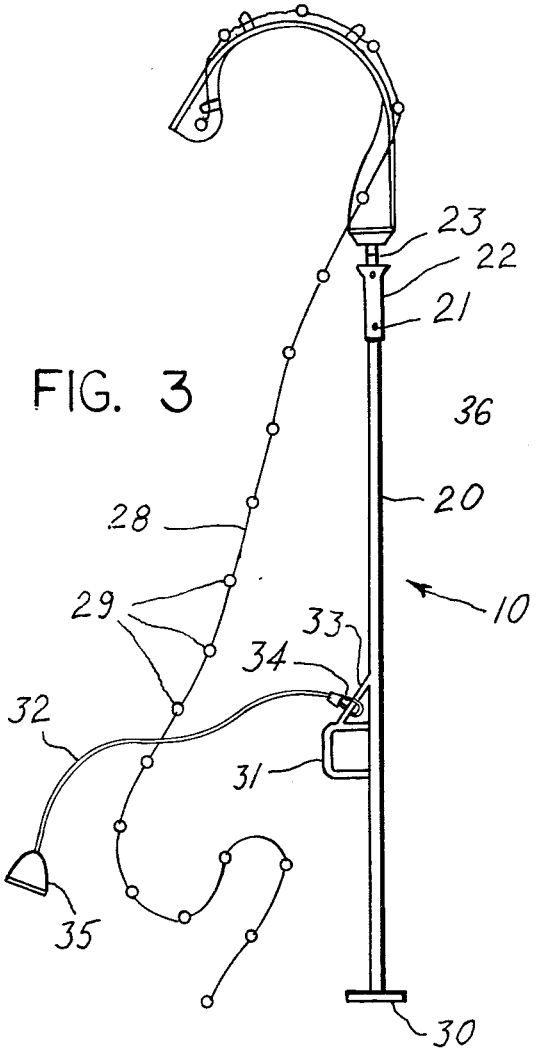
FIG. 3 is a side view of the sky hook.
Figure 4:
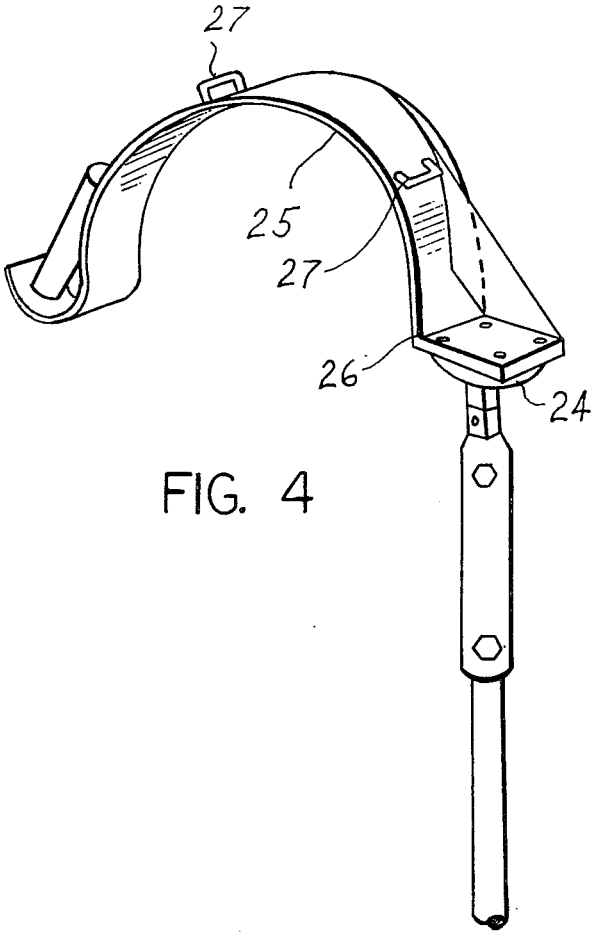
FIG. 4 is a fragmentary perspective view thereof.

Referring now to the drawing in greater detail, the reference numeral 10 represents a derrick sky hook, according to the present invention, for use by a derrick man 11 standing high up upon a floor 12 of an oil drilling derrick 13, and who serves to maneuver stands of pipe 14 from a pipe forked crib 15, and into an opened central area 16, formed within the derrick framework 17, so that the stand of pipe is then positioned properly for being driven down into the ground by the derrick machinery. As shown, the derrick man is conventionally harnessed in a safety belt 18, secured by a tethering line 19 to the framework 17.

The derrick sky hook 10, held by the derrick man, includes a long handle 20, which, at one end, is secured by a bolt and nut assembly 21 to a handle holder 22 having a swivel release 23 adjacent a swivel 24, from where a generally U-shaped hook support 25 extends from its base end 26.

A plurality of rope loops 27 are affixed, spaced apart, along the hook support, and a pull back rope 28 is inserted through the rope loops; the rope having a plurality of spaced-apart knots 29 along its entire length. One end of the rope is secured to the outwardly end of the hook support; the rope then extending around an outer side of the hook support to the hook support base end, from whence the remainder of the rope extends free. The opposite end of the handle is fitted with a cross handle 30.

A hand grasp 31 is rigidly affixed along a side of the handle, and one end of a safety cable 32 is tethered to a brace 33 of the hand grasp, by means of a ring 34. A free end of the safety cable is fitted with a hand grasp 35. The safety cable serves to tie the sky hook to the derrick.

In use of the derrick sky hook, the rope loops are provided for the rope to wrap around the pipe, so that the hook will spin off the pipe. The rope knots are for the derrick man's grasp, in order to help him in pulling back the pipe.

The swivel release is ridged in three directions, but, turned in one direction, will fall away from the derrick man, so that he will not have any obstacles in his way when pulling the pipe back.

In actual use, the handle is held in the one hand, and the rope free end is held in the other hand. After the pipe is hooked, the handle is turned; the handle and the extension will fall away, leaving the derrick man with the knotted rope only. After pulling the pipe back, and putting it in the elevator locks, the derrick man can then push the high tension hook 36 away from him, thus knocking the sky hook off the pipe.

While various changes may be made in the detail construction, it is understood that such changes will be within the spirit and scope of the present invention, as is defined by the appended claims.

What I claim as new, is:

1. A derrick sky hook, comprising, in combination, an elongated handle, a swivel at one end of said handle, and a "U"-shaped hook support carried by its one end on said swivel, a plurality of spaced-apart loops mounted on an outer side of said hook support, a pull back rope inserted through said loops, a plurality of spaced-apart knots along said rope, one end of said rope being secured to an opposite end of said hook support, said rope extending around said outer side of said hook support, an opposite end of said rope being free for grasping in a person's hand during use, a cross-handle on an opposite end of said handle, and a safety cable tethered by its one end to a longitudinally intermediate portion of said handle.

* * * * *